US005245813A

United States Patent [19]

Brotz

[11] Patent Number: 5,245,813

[45] Date of Patent: Sep. 21, 1993

[54] STRUCTURAL BEAM

[76] Inventor: Gregory R. Brotz, P.O. Box 1322, Sheboygan, Wis. 53081

[21] Appl. No.: 722,348

[22] Filed: Jun. 27, 1991

Related U.S. Application Data

[63] Continuation-in-part of Ser. No. 447,429, Dec. 7, 1989, abandoned.

[51] Int. Cl.[5] ..... E04C 3/00

[52] U.S. Cl. ..... 52/727; 156/86; 156/185; 52/720

[58] Field of Search ..... 52/723, 724, 725, 727, 52/720; 156/84, 86, 185, 186, 187, 188, 191, 194; 428/34.9

[56] References Cited

U.S. PATENT DOCUMENTS

| | | | |
|---|---|---|---|
| 4,225,370 | 9/1980 | Dickey | 156/84 |
| 4,598,755 | 7/1986 | Brotz | 164/5 |
| 4,608,284 | 8/1986 | Roales | 428/34.9 |
| 4,692,286 | 9/1987 | Brotz | 264/29.1 |
| 5,043,033 | 8/1991 | Fyfe | 52/725 X |
| 5,071,501 | 12/1991 | Doi et al. | 156/187 |
| 5,076,871 | 12/1991 | Frye et al. | 156/191 X |

FOREIGN PATENT DOCUMENTS

| | | | |
|---|---|---|---|
| 0152019 | 11/1980 | Japan | 156/185 |

*Primary Examiner*—Carl D. Friedman
*Assistant Examiner*—Robert J. Canfield
*Attorney, Agent, or Firm*—William Nitkin

[57] ABSTRACT

A structural beam having a core with a multiplicity of wrappings therearound of shrinkable material, such wrappings being of greater mass than the core and in one embodiment having interlayers of fiber materials between the wrappings of shrinkable material.

4 Claims, 2 Drawing Sheets

STRUCTURAL BEAM

This application is a continuation-in-part of my previous application for A Wrapped Structural Member, Ser. No. 447,429 filed Dec. 7, 1989, now abandoned.

BACKGROUND OF THE INVENTION

1. Field of the Invention

The structural beam of this invention resides in the field of composite structures and more particularly relates to a structural beam having a central framework which is wrapped with planar material, producing a strong lightweight structural beam member.

2. Description of the Prior Art

Applicant has disclosed in his two prior U.S. Pat. Nos. 4,598,755 and 4,692,286 that a central framework can be shrinkwrapped to help achieve a strong lightweight structural member.

SUMMARY OF THE INVENTION

It is an object of this invention to produce structural building beams in a variety of configurations for building the frameworks of a variety of structures including, but not limited to, buildings. Planar materials are wrapped around framework cores during the structural beam's manufacture. Such structural beams can be used for the construction of buildings, aircraft, automobiles, hobby uses or any other purpose where lightweight and strong structural beams are needed.

It should be noted that in my prior inventions as listed in the Description of the Prior Art a specially designed framework was cast and was then wrapped in a shrinkwrap for additional strength. The subject matter of this invention relates not to the framework core but to the final product itself. Any framework core structure is considered to be within the scope of this invention and in practice even a single piece of hardware wire, chicken wire, cage mesh, window screen and the like suffices to form a core which when rolled once around forms a core. The wrap is placed around the core, not merely in a single or in a few layers but, in the subject of this invention, the wrap is applied in a multiplicity of layers forming a large plurality of windings around the core which windings then form the vast majority of the mass of the structural beam so that the core is far less important in the present invention than in my prior inventions. In this invention the structural strength of the structural beam being formed by the large pluralities of windings is derived from the windings which make up well over half the mass of the structural beam.

To produce the structural beam of this invention a central core framework is passed into a wrapping device. The wrapping device can contain one or more rolls of a wrap material which may contain other elements as discussed below. The wrap material is wrapped around the core by the wrapping device, and the wrapped structural beam in one embodiment can be passed through an oven which cures the binder and shrinks the wrap, constricting the wrap against the core and hardening it to form a very strong lightweight structural beam suitable for a variety of construction embodiments.

DESCRIPTION OF THE PREFERRED EMBODIMENT(S)

Figure 1:
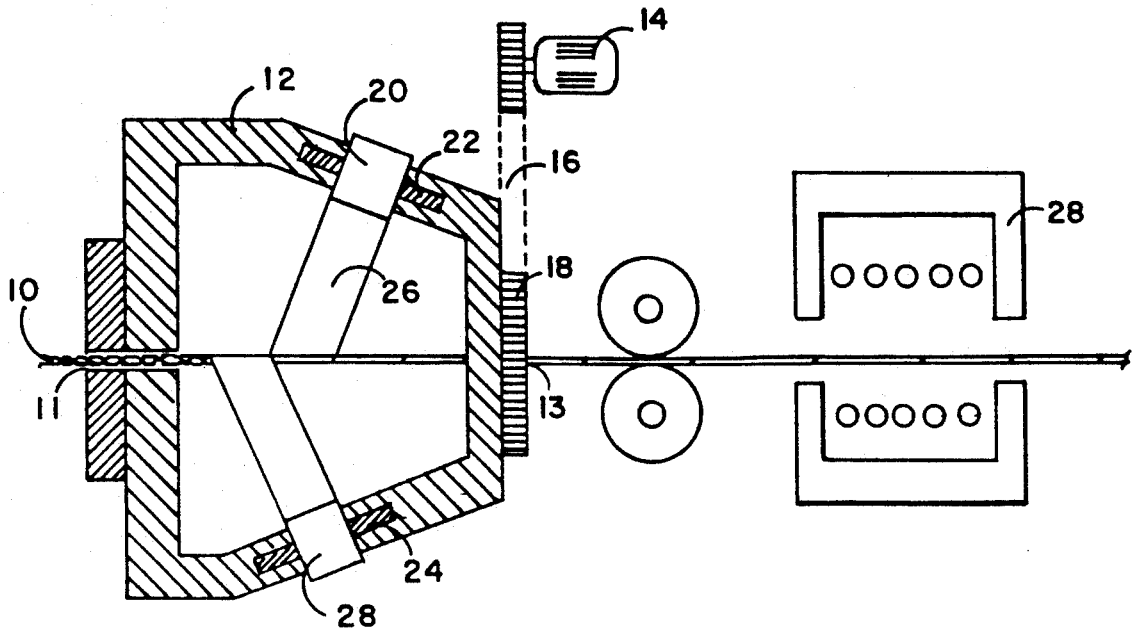
FIG. 1 illustrates a production line showing a continuous wrapping device suitable for producing structural beams of this invention.

FIG. 1 illustrates a cross-sectional view of a production line showing central framework core 10 entering through entry 11 within wrapping device 12. The wrapping device is adapted to rotate around core 10. The central core can be cylindrical or non-cylindrical in shape. The wrapping device can be driven by motor 14 through belt 16 around pulley 18 and supported by structure not seen in FIG. 1 to allow the core to pass through entry 11 in the front and through exit 13 provided in the rear so that the core passes without interference therethrough. First roll 20 of wrapping material is positioned on roll holder 22 on wrapping device 12 and wraps around core 10 as wrapping device 12 rotates therearound. Wrapping material from more than one roll of material can be wrapped around the core 10 at one time and second roll holder 24 is also shown in this view holding second roll 23 of interlayer material. This wrapping material can be shrinkwrap 26 which, as wrapping device 12 rotates, wraps tightly around core 10. The wrapped core then passes out of wrapping device 12 into heating means such as oven 28 where the wrapped casting is heated causing curing and/or shrinking of the wrapping material to tightly bind it to the core. It should be noted that the structure of this invention can be formed by hand as well as made by machines. The wrapping process continues as the core is advanced through the wrapping device so that a large number of wrap windings are placed around the core with the wrapping inself forming the major mass of the structural beam and not merely being a thin covering over a larger framework. A very strong, lightweight structural beam is obtained which can be utilized for the construction of many things such as buildings, for example.

Figure 2:
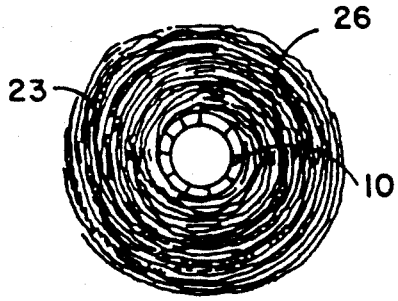
FIG. 2 illustrates a cross-sectional end view through the wrapped structural beam of this invention.

FIG. 2 illustrates a cross-sectional view through a structural beam created by wrapping core 10 with wrapping material 26 and further including interlayer 23. As can be seen in this view, the wrapping material is wound in a large plurality of windings around the core and constitutes the strongest portion of the structural beam.

Figure 3:
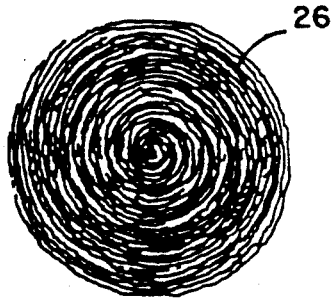
FIG. 3 illustrates a cross-sectional end view through an embodiment of the wrapped structural beam of this invention not having a core.

FIG. 3 illustrates an alternate embodiment of the structure of this invention where no core is utilized, and the wrapping is formed and wrapped around itself.

Figure 4:
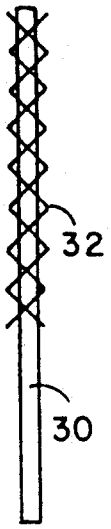
FIG. 4 illustrates a side view of a dowel and screen of an alternate manually wrapped embodiment of this invention.
Figure 5:
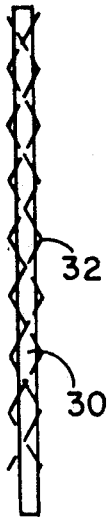
FIG. 5 illustrates a side view of the screen stretched on the dowel seen in FIG. 4.
Figure 6:
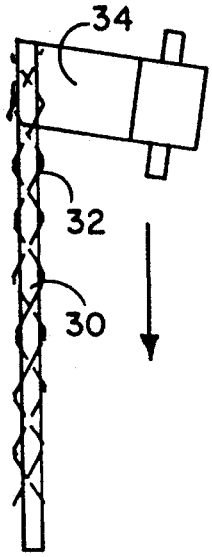
FIG. 6 illustrates a side view of the screen of FIG. 5 starting to be wrapped.
Figure 7:
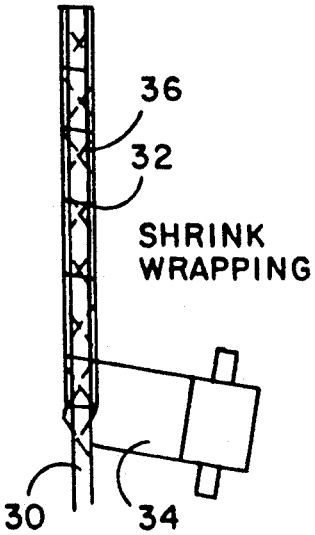
FIG. 7 illustrates a side view of the structure of FIG. 6 having a plurality of wrappings.
Figure 8:
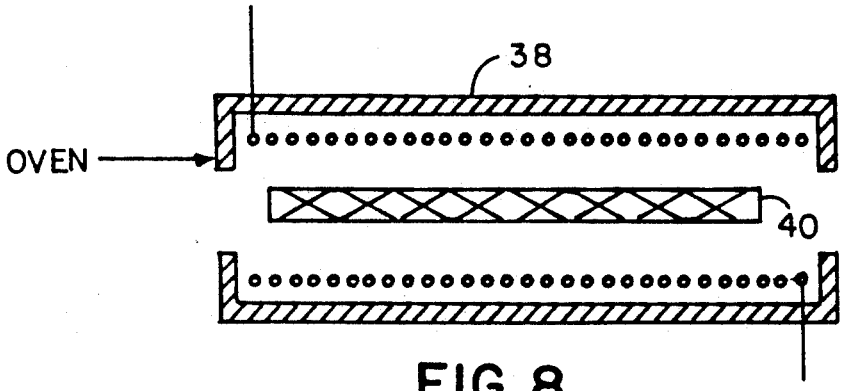
FIG. 8 illustrates a cutaway side view of the wrapped structure of FIG. 7 in an oven.
Figure 9:
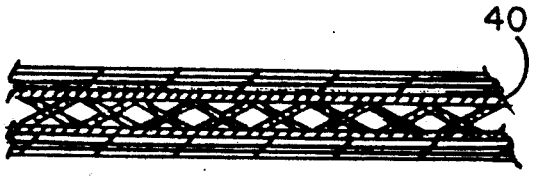
FIG. 9 illustrates a cross-sectional side view of the manually wrapped embodiment.

FIG. 4 illustrates the start of the process of producing a manually wrapped beam starting with a dowel 30 and screen 32. Screen 32 is stretched around dowel 30 as seen in FIG. 5 and wrapping material 34 is wound manually around screen 32 as seen in FIG. 6. FIG. 7 shows the plurality of windings 36 of wrapping material 34 around screen 32. Dowel 30 is then pulled out of the wrapped structure and the wrapped structural beam 40 is then baked in over 38 as seen in FIG. 8 to shrink the multiplicity of layers of shrinkwrap 34 resulting in the wrapped structural beam 40 seen in cross section in FIG. 9.

The wrapping material can be composed of more than one material. In one embodiment the wrapping material can have interlayers of glass fibers coated with a heat-curable binder such as a resin which harden when the wrapped structural beam is passed through an oven or equivalent heating means while the shrinkwrap contracts and tightens around the core and interlayer structure, creating an even stronger integral structural beam. Such a structural beam will resist bending and kinking. It is of further advantage to have any interlayer of glass fibers positioned with the fibers' axes parallel with the axis of the core to help increase the resistance to flexure of the finished product. Interlayers such as resin-impregnated glass mats or veils, reformed fiber mats, resin-impregnated paper, spirally-wound glass roving or carbon-fiber roving can be used. It is expected that the bonding agent to hold the layers of wrap together can be a resin, including any thermoplastic polymer, rubber or glue. Such resin can also be a thermosetting resin or polymer. The contraction of the wrap causes any interlayer fibers to be well wetted and impregnated. In some embodiments the bonding material can be a glue or an adhesive of the type which will bind the layers of wrapping together. The fiber reinforcements can be held within the matrix between the layers of a biaxially oriented polyethylene terephthalate or equivalently oriented shrinkable film. The fibers can be organic polymer fibers or inorganic fibers and can even be of carbon, metal or made of cer-mets. The wrap can be in the nature of films including Mylar film or equivalent where the orientation is such that the strongest direction of stretch of the film is oriented in the same axis as the structure being formed of the wrappings of the material, and one can orient the film onto the core as the tube is being wound. It has been found that such a tube resists flexure, that is, it resists being stretched on one side and compressed on the other side during flexure. By using a film such as polyethylene terephthalate in the direction of the axis of its orientation, a greatly increased tensile strength is created in the final wrapped product.

Other materials that can be utilized within the composite wrap discussed above can include foaming agents which can be added to the binder. For example, a heat-curable epoxy binder with hardener can be combined with a blowing agent and chopped or milled glass fiber and the combination coated onto a shrinkwrap and the shrinkwrap then wrapped around the core and heated. As the heat penetrates, the foaming agent foams the binder, and the heat cures the resin. At the same time, the heat also causes the shrinkwrap to shrink. As the binder foams, the shrinkwrap resists the foaming and the resulting structural wrapping and interlayer fibers are well wetted and impregnated resulting in good strength.

Although the present invention has been described with reference to particular embodiments, it will be apparent to those skilled in the art that variations and modifications can be substituted therefor without departing from the principles and spirit of the invention.

I claim:

1. A structural building beam having a length, said structural beam resistant to flexure and suitable for building the framework of a variety of structures, comprising:

a core having an axis parallel to the length of the structural beam; and a substantially planar shrink wrapping material wrapped a large plurality of times around said core and shrunk wherein said wrapping material has a greater mass than the mass of said core.

2. The structural beam of claim 1 wherein said wrapping material is selected from the group consisting of biaxially oriented polyethylene terephthalate, thermoplastic polymers, and other shrinkable polymer films in which the axis of the film wrapping is parallel to the axis of said core being wrapped.

3. The structural beam of claim 2 wherein said wrapping is bonded to itself by a material selected from the group consisting of resins, rubber and glue.

4. The structural beam of claim 3 wherein said wrapping material is reinforced by an interlayer of fibers selected from the group consisting of glass fibers, carbon fibers, metallic fibers, organic polymer fibers and cer-met fibers.

* * * * *